US012495920B2

(12) United States Patent
Chen et al.

(10) Patent No.: US 12,495,920 B2
(45) Date of Patent: Dec. 16, 2025

(54) CUSHION WITH HEAT PRESERVATION, COLD INSULATION AND FRESHNESS PRESERVATION FUNCTIONS

(71) Applicants: Guojun Chen, Taizhou (CN); Wei Wei, Hangzhou (CN)

(72) Inventors: Guojun Chen, Taizhou (CN); Wei Wei, Hangzhou (CN)

(73) Assignees: Guojun Chen, Taizhou (CN); Wei Wei, Hangzhou (CN)

( * ) Notice: Subject to any disclaimer, the term of this patent is extended or adjusted under 35 U.S.C. 154(b) by 0 days.

(21) Appl. No.: 18/946,800

(22) Filed: Nov. 13, 2024

(65) Prior Publication Data

US 2025/0064235 A1 Feb. 27, 2025

Related U.S. Application Data

(63) Continuation of application No. 18/669,178, filed on May 20, 2024.

(30) Foreign Application Priority Data

Mar. 1, 2024 (CN) ..... 202420393983.9

(51) Int. Cl.
*A47G 9/10* (2006.01)

(52) U.S. Cl.
CPC ..... *A47G 9/10* (2013.01)

(58) Field of Classification Search
CPC ... A47G 9/1045; A45C 3/04; A45F 2004/026; A47C 7/0213
See application file for complete search history.

(56) References Cited

U.S. PATENT DOCUMENTS 2,289,254 A * 7/1942 Eagles ..... A45C 11/20 383/110
2,575,191 A * 11/1951 Seipp ..... F25D 3/08 383/110
2,730,151 A * 1/1956 Smith ..... A45C 3/00 383/110
3,263,246 A * 8/1966 Towery ..... A45C 3/10 5/639

(Continued)

FOREIGN PATENT DOCUMENTS

CN 117860066 A * 4/2024 ..... A47C 16/00
CN 221730146 U * 9/2024 ..... A47C 16/00

(Continued)

*Primary Examiner* — Eric J Kurilla
(74) *Attorney, Agent, or Firm* — Reising Ethington P.C.

(57) ABSTRACT

A cushion with heat preservation, cold insulation and freshness preservation functions is provided, relating to the technical field of home and outdoor patio leisure products. The cushion includes an outer cover and an inner core, as well as a containing bag located in the inner core. The bag body of the containing bag is provided with an insulation layer, and the opening of the containing bag corresponds to the first opening and closing structure of the outer cover. In outdoor camping and other scenarios, items that need heat preservation can be placed in the containing bag, which can reduce the number and volume of items needed to be carried, making them easy to carry, on the other hand, items such as food can also be insulated and kept fresh, making it convenient for users.

13 Claims, 4 Drawing Sheets

(56) References Cited

U.S. PATENT DOCUMENTS 3,763,972 A * 10/1973 Karzmar ..... A45C 9/00 383/110
3,863,283 A * 2/1975 Mohr ..... A47G 9/1045 5/639
4,185,673 A * 1/1980 Daniello ..... A45C 9/00 383/110
4,277,859 A * 7/1981 Seaman ..... A45C 9/00 5/413 R
4,298,103 A * 11/1981 De Fries ..... A45C 9/00 383/110
4,679,242 A * 7/1987 Brockhaus ..... A45C 7/0059 383/18
4,945,589 A * 8/1990 Carey ..... A47C 4/52 5/653
4,959,880 A * 10/1990 Tesch ..... A47G 9/10 5/636
5,515,564 A * 5/1996 Lyons ..... A47C 1/14 5/639
5,545,198 A * 8/1996 Owens ..... A47C 7/744 607/108
5,816,463 A * 10/1998 Echeverri ..... A45C 15/00 224/268
6,088,856 A * 7/2000 Boyer ..... A47G 9/1045 5/639
7,441,292 B2 * 10/2008 Williams ..... A45F 4/02 5/636
7,517,013 B1 * 4/2009 Lowe ..... A47C 7/742 297/188.2
8,127,382 B1 * 3/2012 Plascencia ..... A47G 9/1045 5/639
8,556,337 B1 * 10/2013 Cornitius-Cary ..... A47C 7/746 297/188.2
9,950,830 B2 * 4/2018 de Lesseux ..... B65D 81/3897
11,313,605 B2 * 4/2022 Kieling ..... B65D 43/22
12,053,112 B1 * 8/2024 Taylor ..... A47G 9/10
2003/0116465 A1 * 6/2003 Wilson, II ..... A45C 3/00 206/522
2005/0262634 A1 * 12/2005 Gottlieb ..... A45F 4/06 5/482
2008/0215440 A1 * 9/2008 Peterson ..... B65D 77/046 53/473
2009/0021386 A1 * 1/2009 Liao ..... A47C 7/723 340/667
2010/0295339 A1 * 11/2010 Siu ..... B60N 2/5635 297/180.14
2015/0164228 A1 * 6/2015 Scorgie ..... A47C 31/11 297/229
2017/0231410 A1 * 8/2017 Chon ..... A47G 9/10 5/640
2019/0002185 A1 * 1/2019 Carroll ..... A45C 3/06
2019/0380460 A1 * 12/2019 Marsh ..... A45F 4/02
2023/0159228 A1 * 5/2023 Greenfield ..... A45C 7/0077 383/6

FOREIGN PATENT DOCUMENTS

CN 221903004 U * 10/2024
DE 202024105616 U1 * 11/2024 ..... A47G 9/10
JP 3115093 U * 11/2005
JP 3249362 U * 12/2024
KR 20050033337 A * 4/2005 ..... A47G 9/10
KR 20120004911 U * 7/2012
WO WO-2018041404 A1 * 3/2018 ..... A45C 7/00
WO WO-2024017922 A1 * 1/2024 ..... A45C 13/02

* cited by examiner

CUSHION WITH HEAT PRESERVATION, COLD INSULATION AND FRESHNESS PRESERVATION FUNCTIONS

CROSS-REFERENCE

This application claims to the benefit of priority from Chinese Application No. 202420393983.9 with a filing date of Mar. 1, 2024. The content of the aforementioned application, including any intervening amendments thereto, are incorporated herein by reference.

TECHNICAL FIELD

The present disclosure relates to the technical field of home and outdoor patio leisure products, in particular to a cushion with heat preservation, cold insulation and freshness preservation functions.

BACKGROUND

Soft cushion is a common item used in home and daily life, mainly including headrests and throw pillows, and seat cushions. However, the soft cushions in existing technology can only serve as a reliable support, with a single function and limited usage scenarios. For example, when in the outdoor camping and leisure scene, it not only needs to carry a throw pillow for support and rest, but also requires to carry food for eating and enjoying. However, on the one hand, the throw pillow is fluffy and bulky, making it inconvenient to carry, and on the other hand, the food is prone to cold and outdoor heating is inconvenient.

SUMMARY

In view of the deficiencies of the existing technology described above, the objective of the present disclosure is to provide a cushion with heat preservation, cold insulation and freshness preservation functions, which is used to solve the problem of a single function of the cushion in the prior art, lack of accommodation space, and inability to freshness preservation for food.

To achieve the above and other related purposes, a cushion with heat preservation, cold insulation and freshness preservation functions is provided by the present disclosure, which includes an outer cover and an inner core, wherein the outer cover is provided with a first opening and closing structure, and further comprises a containing bag located in the inner core, a bag body of the containing bag is provided with an insulation layer, and an opening of the containing bag corresponds to the first opening and closing structure.

Optionally, the cushion further includes a flexible strap;

the flexible strap is wrapped around the middle of the outer cover as a middle belt;

and/or, fasteners are provided on both sides of the first opening and closing structure on the outer cover, and the flexible strap is connected to the outer cover through the fasteners.

Optionally, two ends of the flexible strap is fixedly connected to two fasteners, respectively;

or, the flexible strap is fixedly connected end-to-end itself after passing through two fasteners.

Optionally, wherein a fixed connection method of the flexible strap is detachable or non-detachable.

Optionally, a second opening and closing structure corresponding to the opening of the containing bag is provided on the inner core, and, the containing bag is limited within the inner core when the second opening and closing structure is closed.

Optionally, the opening of the containing bag is provided with a third opening and closing structure, and the third opening and closing structure is capable to open or seal the containing bag.

Optionally, the third opening and closing structure is a zipper, button, hook& Loop fastener or magnetic buckle.

Optionally, the containing bag is an integral structure with the inner core, or the containing bag is detachably connected to the inner core.

Optionally, the insulation layer of the containing bag is a double-layer structure of tin foil layer and fiber layer.

Optionally, the cushion further includes flexible straps and fasteners, wherein the fasteners are arranged at four corners of the outer cover, and the number of the flexible straps is two;

two of the flexible straps are connected through the fasteners vertically distributed on both sides of the outer cover to form two shoulder straps;

or, one of the flexible straps is connected to form a handle strap through the fasteners horizontally distributed at a top of the outer cover, while the other flexible straps is connected through fasteners at a bottom of the outer cover and tightens the bottom of the outer cover.

As mentioned above, a cushion with heat preservation, cold insulation and freshness preservation functions of the present disclosure has at least the following advantageous effect:

The cushion provided by the present disclosure is provided with accommodation space for storage and the heat preservation function. Specifically, the cushion includes an outer cover and an inner core, as well as a containing bag located in the inner core. The bag body of the containing bag is provided with an insulation layer, and the opening of the containing bag corresponds to the first opening and closing structure of the outer cover. In outdoor camping and other scenarios, items that require heat preservation can be placed in the containing bag, which can reduce the number and volume of items needed to be carried, making them easy to carry, on the other hand, items such as food can also be insulated and kept fresh, making it convenient for users.

Figure 1:
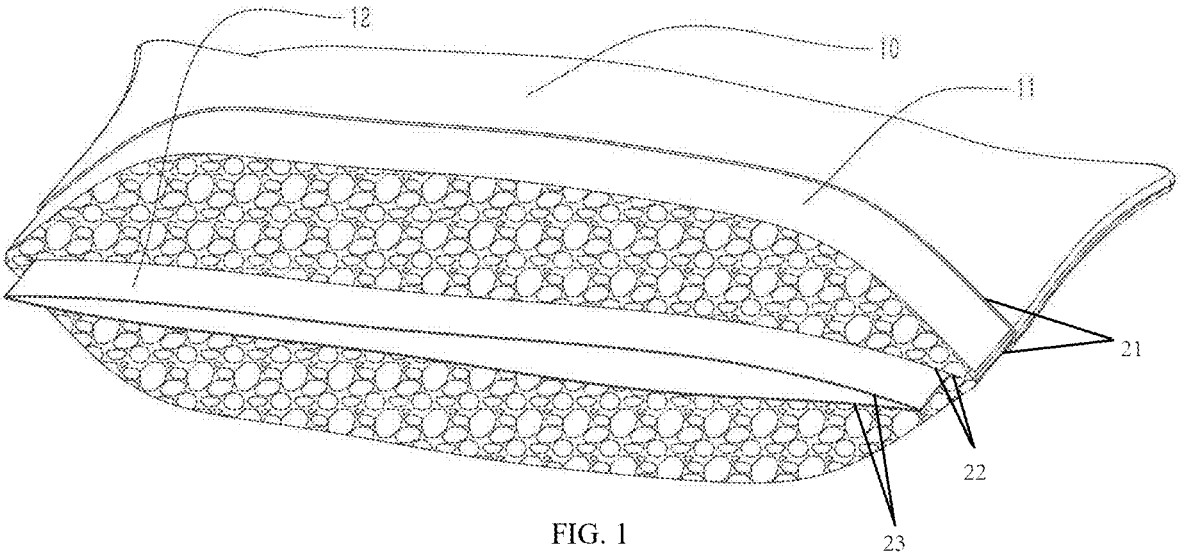
FIG. 1 is a schematic diagram of the internal cross-section of the present disclosure.

Reference numbers in the drawings: 10—outer cover, 11—inner core, 12—containing bag, 13—flexible strap, 101—fastener.

DETAILED DESCRIPTION OF THE EMBODIMENTS

The following are specific embodiments to illustrate the embodiments of the present disclosure. Those familiar with the art can easily understand the other advantages and effects of the present disclosure from the content disclosed in this disclosure.

Please refer to FIGS. 1 to 8. Note that the structures, proportions, sizes, etc. depicted in the accompanying drawings of the specification are only intended to complement the content disclosed in the specification for those familiar with the art to understand and read, and are not intended to limit the limitations of the present disclosure. Therefore, they do not have any technical substantive significance. Any modifications to the structure, changes in the proportion relationship, or adjustments in size should still fall within the scope of the technical content disclosed in the present disclosure, without affecting the efficacy and goals that can be achieved. Meanwhile, the terms such as "up", "down", "left", "right", "middle", and "one" cited in the specification are only for the convenience of description and are not intended to limit the scope of the present disclosure. Any changes or adjustments in their relative relationships, without substantial technical changes, shall also be considered as the scope of the present disclosure.

The following embodiments are for illustrative purposes only. Various embodiments can be combined, which is not limited to the content presented in the following individual embodiments.

Please refer to FIG. 1 for the embodiment. The present disclosure provides an embodiment of a cushion with heat preservation, cold insulation and freshness preservation functions, including an outer cover 10 and an inner core 11. The inner core 11 is arranged inside the outer cover 10, which is not much different from a common cushion or pillow. The outer cover 10 is provided with a first opening and closing structure 21. The cushion also includes a containing bag 12 located in the inner core 11. The bag body of the containing bag 12 is provided with an insulation layer, and the opening of the containing bag 12 corresponds to the first opening and closing structure 21, so that items are allowed to be put in or taken out. The outer cover 10 can be a fabric cover, and the material can be selected from outdoor functional fabrics, which have weather resistance, sunproof, as well as water resistant, stain resistant, and oil resistant functions. It is suitable for various occasions including outdoor activities. The first opening and closing structure 21 on the outer cover 10 can be a zipper, hook& Loop fastener, etc. The inner core 11 is a filling layer filled with PP fiber, non-glue fiber, polyester fiber, foam, cotton, or polystyrene beads, etc. The inner core 11 not only ensures the appearance of the product is consistent with that of common throw pillow or pad, but also plays a good role in heat insulation and cold insulation. The containing bag 12 serves as a contact layer, directly in contact with things that need heat insulation and cold insulation. The material can be tin foil paper with polyester fiber, which comes into contact with things that need heat insulation and cold insulation. Tin foil paper has excellent heat reflection function and can play a very good role in heat insulation and cold insulation. In summary, the cushion has storage and heat insulation functions. For example, in camping and other scenarios, items that need heat insulation can be placed in a containing bag. On the one hand, it can reduce the number and volume of items needed to be carried, making them easy to carry, on the other hand, items such as food can also be insulated and kept fresh, making it convenient for users.

Figure 2:
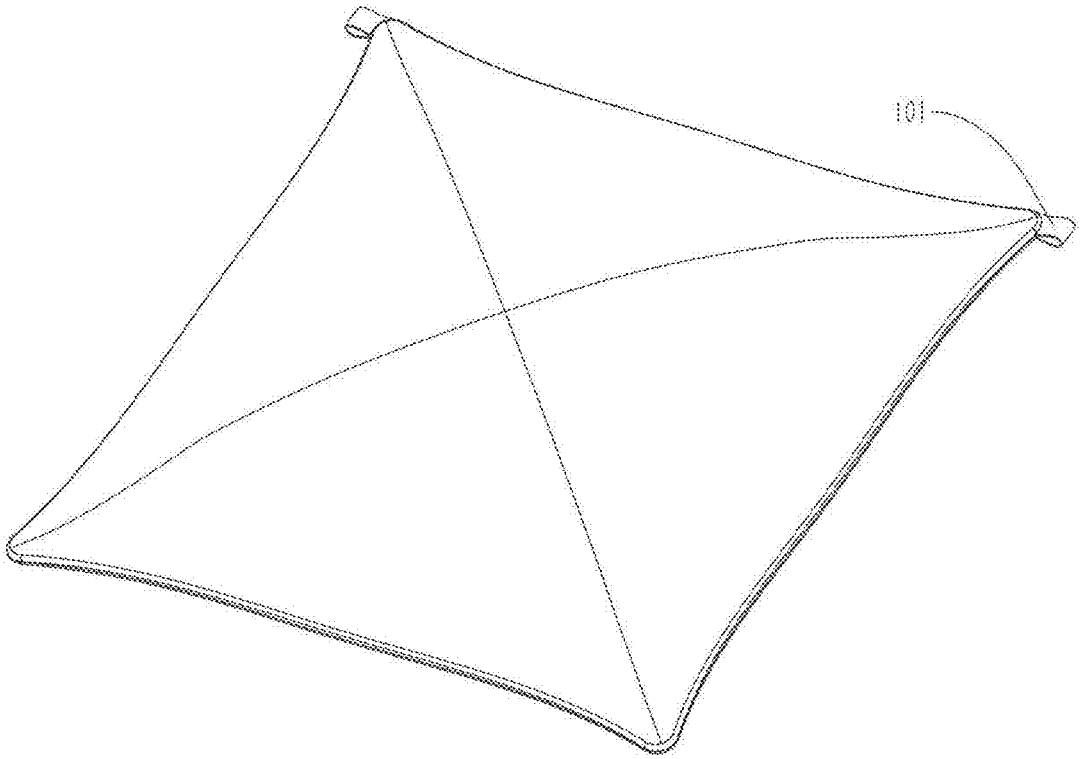
FIG. 2 is a schematic diagram of one of fastener positions of the present disclosure.
Figure 3:
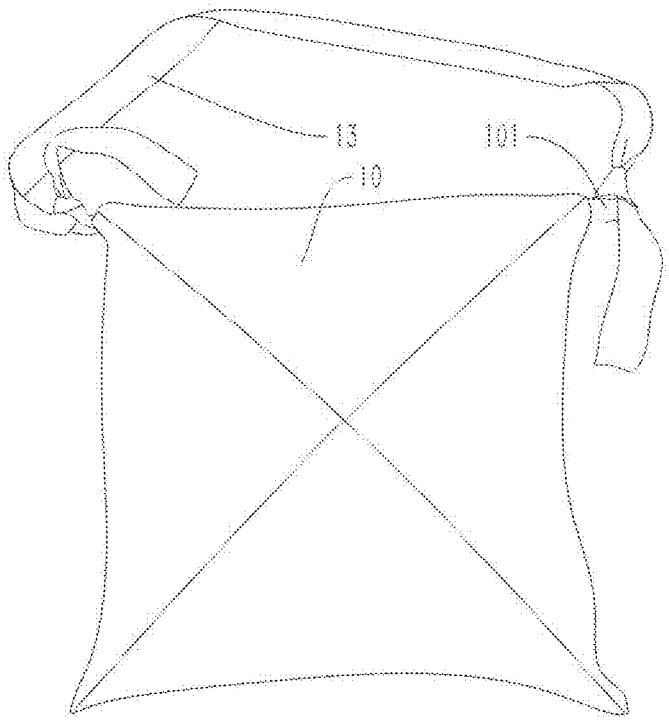
FIG. 3 is a schematic diagram of one connection method for the flexible straps of the present disclosure.
Figure 4:
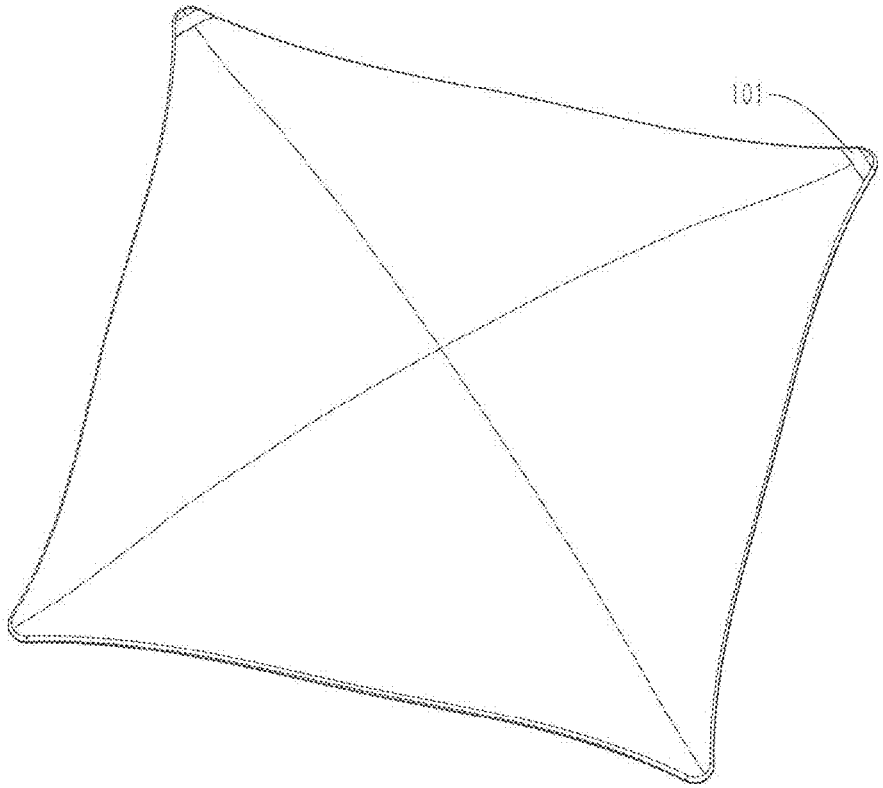
FIG. 4 is a schematic diagram of another fastener position of the present disclosure.
Figure 5:
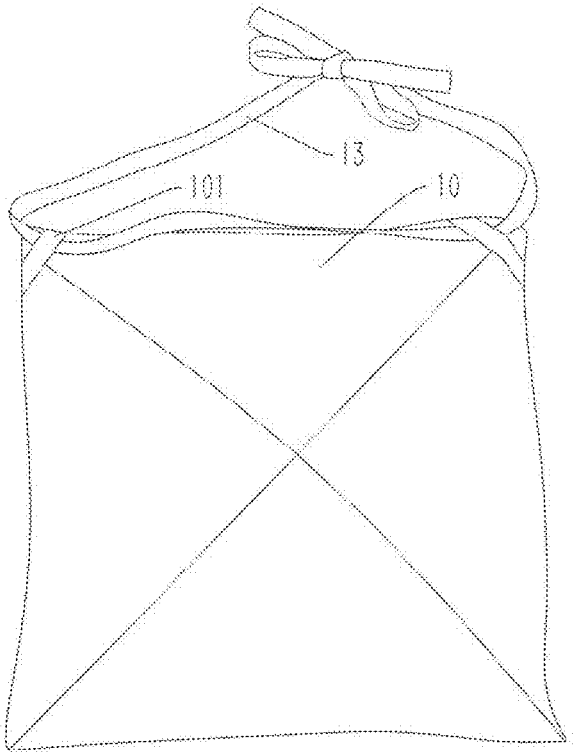
FIG. 5 is a schematic diagram of another connection method for the flexible straps of the present disclosure.
Figure 6:
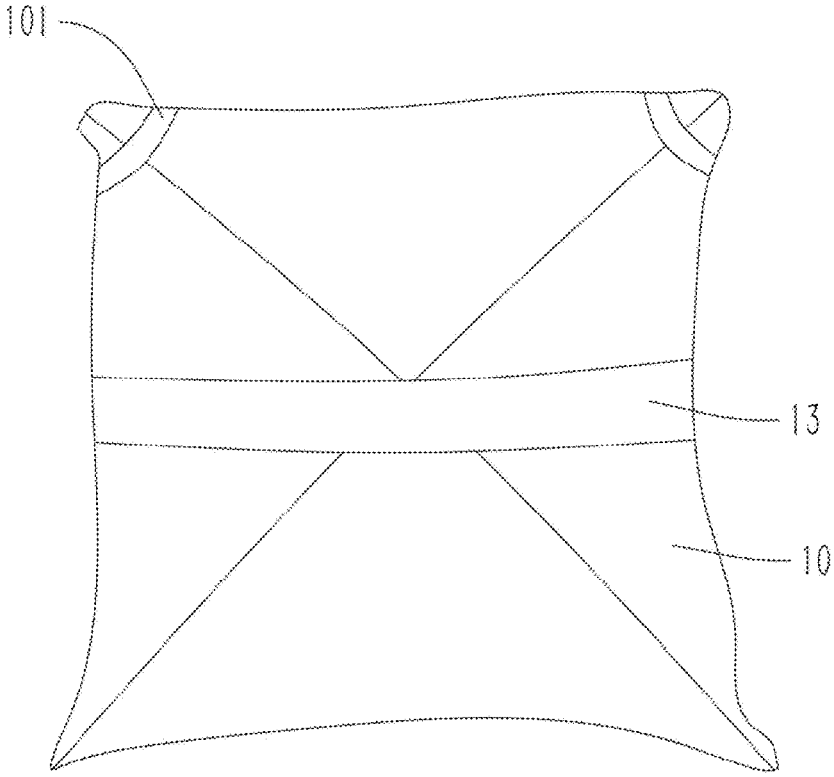
FIG. 6 is a schematic diagram of using the flexible strap as the middle belt of the outer cover of the present disclosure.

Please refer to FIGS. 3-5 for the embodiment, it further includes flexible straps 13. The outer cover 10 is provided with fasteners 101 on both sides of the first opening and closing structure 21, and the flexible straps 13 are connected to the outer cover 10 through fasteners 101. After assembling the flexible straps 13, combined with the first opening and closing structure 21 on the outer cover 10, the cushion can be used as a backpack or shoulder bag. After removing the flexible straps 13 and closing the first opening and closing structure 21, the cushion can be used as a normal throw pillow or pad. The fasteners 101 can be used either as shown in FIGS. 2 and 4, or in other ways, as long as it can allow the flexible straps 13 to pass through. The flexible straps 13, combined with the fasteners 101, can achieve changes in the cushion function to cope with different scenarios. It can be used as a shoulder bag to accommodate items during carrying and as a pillow cushion during rest. As shown in FIGS. 5 and 6, the flexible straps 13 can use cloth straps with a certain width. When used as a backpack or shoulder bag as a whole, the wider flexible straps 13 can reduce the squeezing feeling on the hands or shoulders of the human body, making it more comfortable to carry or lift. At the same time, when cloth straps with a certain width is wrapped around the outer cover 10 as middle belts, the use effect is better. According to the different use conditions, the flexible straps 13 can switch into middle belt, shoulder strap, or lifting strap, and has specific functions and effect in both states.

Furthermore, as shown in FIG. 3, the two ends of the flexible straps 13 are fixedly connected to two fasteners 101 respectively. Alternatively, as shown in FIG. 5, the flexible straps 13 can be fixedly connected to end-and-end itself after passing through two fasteners 101. The fixed connection methods of the flexible straps 13 can be detachable or non-detachable. Wherein detachable connections include knotting, using buckles, etc. The advantage of buckles compared to knotting is that they are easy to adjust in length. For example, buckles are often used in schoolbag straps and leather straps, while the advantage of knotting is that they are easy to use and do not leave buckles on the outer cover 10 after the flexible straps 13 is removed.

In the embodiment, the inner core 11 is provided with a second opening and closing structure 22 corresponding to the bag opening of the containing bag 12. When the second opening and closing structure 22 is closed, the containing bag 12 is limited to the inner core 11. The second opening and closing structure 22 can limit the opening of the containing bag 12, prevent unexpected detachment of the containing bag 12 from the inner core 11, and improve the containing and insulation effects.

In the embodiment, the opening of the containing bag 12 is provided with a third opening and closing structure 23, which can open or seal the containing bag 12. The bag body of the containing bag 12 is an insulation layer, and the sealing of the bag body can improve the insulation effect. The third opening and closing structure 23 can be a zipper, button, hook& loop fastener or magnetic buckle, etc. The containing bag 12 is provided with a third opening and closing structure 23, which can maintain insulation when the containing bag 12 is removed from the cushion for use.

Furthermore, the containing bag can be integrated with the inner core, or the containing bag 12 can be fixedly connected to the inner core 11, or the containing bag 12 can be detachably connected to the inner core 11. When the containing bag is integrated with the inner core, the inner core is folded and three sides of the folded inner core are sewed with one opening left to form the containing bag. The insulation layer of the containing bag body can be the filling material for the inner core. When the containing bag 12 is detachably connected to the inner core 11, the containing bag 12 can be taken out. At this time, the cushion, like a common cushion, can be used as a pillow support tool. On the other hand, the containing bag 12 can be removed for easy replacement or for cleaning of the contaminated food residues, oil stains and the like, to avoid contaminating the inner core 11. The insulation layer of the containing bag 12 can be a double-layer structure of tin foil layer and fiber layer. The fiber layer can be pure cotton, polyester fiber, or other materials with insulation functions. By isolating heat, it has good heat preservation and freshness preservation effects.

Figure 7:
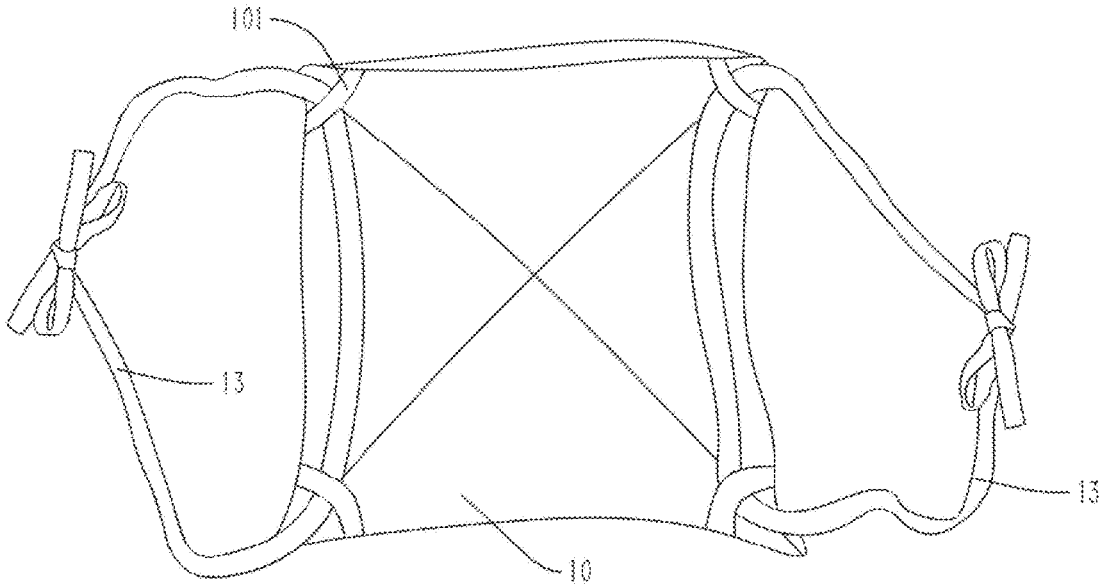
FIG. 7 is a schematic diagram shown that the present disclosure transforms into a backpack.
Figure 8:
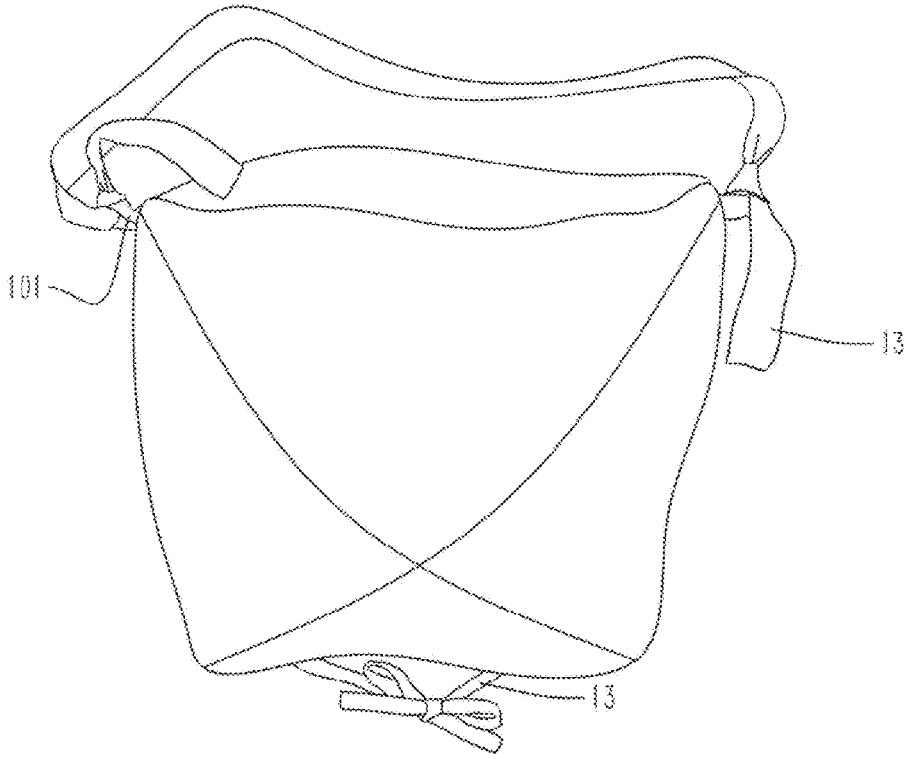
FIG. 8 is a schematic diagram shown that the present disclosure transforms from a flat state to a three-dimensional state.

Please refer to FIGS. 7-8 for the embodiment, it further includes flexible straps 13 and fasteners 101. The fasteners 101 are provided at the four corners of the outer cover 10, and the number of flexible straps 13 is two. The two flexible straps 13 are respectively connected through the vertically distributed fasteners 101 on both sides of the outer cover 10 to form two shoulder straps, which becomes a backpack as a whole. Alternatively, one of the flexible straps 13 is connected through the fasteners 101 horizontally distributed at the top of the outer cover 10 to form a handle strap, which becomes a handbag as a whole. The other one of flexible straps 13 is connected and tightened at the bottom of the outer cover 10 through the fasteners 101 at the bottom of the outer cover 10, which becomes three-dimensional as a whole, besides, when placing heavy objects, it can has better load bearing. The third flexible strap 13 can also be used, placed at the middle of the outer cover 10, to tighten and restrain items inside the handbag or backpack, preventing them from shaking.

In the above embodiments, multiple states of throw pillow, cushion, backpack, and handbag can be conveniently switched, and users can choose according to their actual need. When in a handbag state, the flexible straps 13 at the bottom can be tightened to transform the originally flat outer cover into a three-dimensional shape. Combined with the characteristics of heat preservation and freshness preservation, it can be used to carry large cylindrical objects such as water cups and lunch boxes. When in a handbag state, the flexible straps 13 at the bottom can also be left loose. At this time, the shape of the handbag is close to the flat shape of a common shoulder bag, and it can carry small personal items such as phones, keys, and wallets. Similarly, when in a backpack state, the bottom of the outer cover 10 can be tightened or left loose, but if the bottom of the backpack is tightened, an extra flexible strap 13 is required in addition to two shoulder straps need to prepared. In short, the cushion or bag in the embodiment has rich forms and functions, and can cope with various different use scenarios and needs.

In summary, the present disclosure effectively overcomes various disadvantages in existing technology, can produce beneficial technical effects, and has significant progress.

The above embodiments are only illustrative of the principle and efficacy of the present disclosure, and are not intended to limit the present disclosure. Anyone familiar with this art may modify or change the above embodiments without departing from the spirit and scope of the present disclosure. Therefore, all equivalent modifications or changes completed by those with the common skilled person in the art without departing from the spirit and technical ideas disclosed in the present disclosure should still be covered by the claims of the present disclosure.

What is claimed is:

1. A cushion for heat preservation, cold insulation, and freshness preservation, comprising:

an outer cover having a first opening and closing structure configured to open or close the outer cover;

an inner core disposed within the outer cover; and a containing bag positioned within the inner core, wherein the containing bag comprises a bag body provided with an insulation layer and a second opening and closing structure configured to open or seal the containing bag, wherein the insulation layer of the bag body comprises a composite double-layer structure including a foil layer and a fiber layer;

wherein the containing bag is detachably connectable to or integrally formed with the inner core; and wherein the outer cover comprises fasteners at multiple positions, and at least one flexible strap is selectively attachable to the fasteners to convert the cushion into a backpack, a handbag, or a pillow configuration.

2. The cushion for heat preservation, cold insulation, and freshness preservation as claimed in claim 1 wherein the at least one flexible strap is wrapped around a middle of the outer cover as a middle belt; and/or the outer cover comprises fasteners disposed on both sides of the first opening and closing structure, and the at least one flexible strap is connected to the outer cover through the fasteners.

3. The cushion for heat preservation, cold insulation, and freshness preservation as claimed in claim 2, two ends of the flexible strap are fixedly connected to two fasteners, respectively; or the flexible strap is fixedly connected end-to-end after passing through two fasteners.

4. The cushion for heat preservation, cold insulation, and freshness preservation as claimed in claim 3, wherein a fixed connection method of the flexible strap is detachable or non-detachable.

5. The cushion for heat preservation, cold insulation and freshness preservation as claimed in claim 1, wherein the second opening and closing structure is positioned on an opening of the inner core and configured to open or seal the inner core, allowing the containing bag to be inserted or removed.

6. The cushion for heat preservation, cold insulation, and freshness preservation as claimed in claim 1, wherein the third opening and closing structure is positioned on an opening of the containing bag and is configured to open or seal the containing bag.

7. The cushion for heat preservation, cold insulation, and freshness preservation as claimed in claim 6, wherein the third opening and closing structure is a zipper, button, hook & loop fastener, or magnetic buckle.

8. The cushion for heat preservation, cold insulation, and freshness preservation as claimed in claim 1, wherein the containing bag is detachably connected to the inner core for cleaning or replacement.

9. The cushion for heat preservation, cold insulation, and freshness preservation as claimed in claim 1, wherein the fiber layer is selected from cotton, polyester fiber, or other insulation materials.

10. The cushion for heat preservation, cold insulation, and freshness preservation as claimed in claim 1, further comprising flexible straps and fasteners, wherein the fasteners are arranged at four corners of the outer cover, and the number of the flexible straps is two; and two of the flexible straps are connected through the fasteners vertically distributed on both sides of the outer cover to form two shoulder straps; or one of the flexible straps is connected through the fasteners horizontally distributed at a top of the outer cover to form a handle strap, while the other flexible straps is connected through fasteners at a bottom of the outer cover to tighten the bottom of the outer cover.

11. The cushion for heat preservation, cold insulation, and freshness preservation as claimed in claim 1, wherein the outer cover is formed of an outdoor functional fabric having at least one of weather resistance, water resistance, stain resistance, and oil resistance.

12. The cushion for heat preservation, cold insulation, and freshness preservation as claimed in claim 1, wherein the inner core comprises a filling material selected from PP fiber, polyester fiber, foam, cotton, or polystyrene beads.

13. The cushion for heat preservation, cold insulation, and freshness preservation as claimed in claim 1, wherein the outer cover is configured as a throw pillow.

* * * * *